US006006759A

United States Patent [19]

Goodwin

[11] Patent Number: 6,006,759

[45] Date of Patent: Dec. 28, 1999

[54] HAIR ROLLER AND METHOD FOR USING THE SAME

[76] Inventor: Terri R. Goodwin, 204 Madrona Way, Bainbridge Island, Wash. 98110

[21] Appl. No.: 09/153,097

[22] Filed: Sep. 14, 1998

[51] Int. Cl.[6] ..... A45D 2/16

[52] U.S. Cl. ..... 132/250

[58] Field of Search ..... 132/222, 226, 132/245, 248, 250, 251, 253, 275

[56] References Cited

U.S. PATENT DOCUMENTS

| | | | |
|---|---|---|---|
| 729,587 | 6/1903 | Hogan | 132/248 |
| 944,226 | 12/1909 | West | 132/248 |
| 1,719,555 | 7/1929 | Lewis et al. | 132/222 |
| 2,625,941 | 1/1953 | Harrington | 132/250 |
| 2,962,031 | 11/1960 | Bumgarner | 132/245 |
| 3,186,415 | 6/1965 | Teopilan | 132/248 |
| 4,002,180 | 1/1977 | Maier et al. | 132/248 |

FOREIGN PATENT DOCUMENTS

| | | | |
|---|---|---|---|
| 933800 | 4/1948 | France | 132/250 |
| 2663518 | 12/1991 | France | 132/248 |
| 2203940 | 11/1988 | United Kingdom | 132/248 |

*Primary Examiner*—Todd E. Manahan
*Assistant Examiner*—Eduardo C. Robert
*Attorney, Agent, or Firm*—Kaye, Scholer, Fierman, Hays & Handler, LLP

[57] ABSTRACT

A hair care accessory to form curls in a user's hair is disclosed. The accessory has a roller body having a first end and a second end, and a ribbon wherein a first end of the ribbon is attached to the roller body substantially at the first end thereof, and wherein the first end of the roller body defines a helical slit depending from the surface thereof. A hair retention device is associated with the accessory to temporarily locate the terminal portions of the hair and a segment of the ribbon after having wrapped the same about the roller body. A preferred embodiment uses a cylindrical solid of resilient material for the roller body wherein the helical slit generally depends to the axis of the roller body, and the hair retention device is characterized as a bisecting slit.

7 Claims, 2 Drawing Sheets

HAIR ROLLER AND METHOD FOR USING THE SAME

FIELD OF THE INVENTION

The present invention relates to the field of personal hair care products, and more particularly to hair accessories intended to assist in imparting curls to a head of human hair.

BACKGROUND OF THE INVENTION

A virtual plethora of hair roller products are presently available on the commercial market. Each type of roller has its own advantages and disadvantages. For instance, hard rollers have a generally cylindrical profile and a foramous surface which permit rapid moisture exchange from the internal portion of the cylinder to the exterior environment, thus enhancing drying properties. Unfortunately, such products make it difficult to sleep with the rollers in one's hair, given their rigidity. Soft foam type rollers, while suitable for use while sleeping, suffer from poor moisture exchange and especially unintentional hair unraveling.

There is a long felt need in this area of technology to provide a comfortable hair roller that also provides superior hair holding abilities in addition to curl tightness versatility. The present invention is intended to meet these and other needs.

Importantly, none of the prior art teaches or suggests a resilient roller body and a non-elastic ribbon-type fastener, between which is secured rolled hair. Also, none of the prior art discloses a hair roller having a helical first slit on a first end and a second slit on a second end such that the first and second slits secure both the wrapping ribbon and the rolled hair.

SUMMARY OF THE INVENTION

The present invention is directed to imparting curl into a bundle of hair strands and comprises a roller body having a first end and a second end wherein the first end defines a slit depending from the exterior surface of the roller body into the body of the roller; and a ribbon, wherein a first or terminal portion of the ribbon is attached to the roller body substantially at the first end. The running length of the slit is variable but is sufficient to permit a portion of the bundle of hair strands to be wrapped and reside therein. By positioning the bundle of hair strands thereat, a wrapping bias is created, aiding the user in wrapping bundle of hair strands about the roller body.

In a preferred embodiment, the roller body is cylindrical and the slit length terminates after sweeping out an approximately 90° angular rotation, thus forming a partial helical slit in the roller body. In a preferred embodiment, the terminal end of the ribbon is disposed in the helical slit. In this manner, both the inserted bundle of hair strands and the ribbon are subject to a helical wrapping bias.

A distal hair retaining means is located generally at the second end of the roller body to hold the bundle of hair strands and the ribbon thereto. In one embodiment, the hair retaining means comprises a bisecting slit extending in a coaxial direction from the end surface of the second end of the roller body partially into the body towards the roller first end. This slit permits location of the distal portion of the hair bundle and ribbon therein. Alternatively, this slit may be comprised of sections, each oriented at an angle relative to adjacent sections, to form a serrated slit. In another embodiment, a radially constricting band is locatable on the roller body surface at a user selected location. This type of construction permits users having long or short hair to use the invention without having to purchase specialized roller lengths. Thus, a user having short hair would not have to purchase short length rollers, only to purchase longer rollers (for the same curl type) if she later desired to have longer hair. By the same token, manufacturing and packaging costs are reduced since only one type of roller is needed.

While the length of the ribbon is variable, greatest versatility can be achieved when the length is approximately three times the length of the roller body. As is well known in the art, tighter curls can be achieved by choosing a smaller diameter roller, and when wrapping the hair on the roller, locating subsequent wraps closely adjacent to the previous wrap. Conversely, looser curls can be achieved by increasing the axial space between adjacent wraps on the roller. With respect to the present invention, the ribbon is overlayed on the hair bundle being wrapped about the roller body. Taking into account the average wrapped width of a hair bundle, it has been determined that in most circumstances, the maximum number of wraps that can be achieved for a roller is about five. If looser curls are desired, then only two, three, or four wraps might be carried out. In such cases, the second end of the ribbon merely remains disengaged from the roller as the hair retaining means engages the ribbon at a location further towards the terminal end.

The first end of the roller body may have an enlarged head. The enlarged head provides the user with a gripping area and also supports the rolled hair on the roller body to prevent undesired, premature unrolling of the hair from the roller body.

An embodiment of the invention also includes a terminal retainer. By using a terminal retainer, the hair strand bundle/ribbon combination is securely held to the roller body. The terminal retainer may be a radially constricting band or clip, or any other retainer that operates to keep the bundle/ribbon combination in place during use of the invention.

In a preferred form, the roller body is constructed of a solid cylinder of resilient material. The helical cut depends into the roller body about to the axis thereof. By the same token, the second slit bisects the cylinder so that two semicircular solids are formed. The terminal end of the ribbon is fixedly locatable in the helical slit. Alternatively, the roller body may be formed into a rectangular prism to cause wrapped hair to exhibit a "kinked" appearance.

A method of using the instant invention comprises the steps of locating a bundle of hair strands in the slit defined by the first end of the roller body; simultaneously wrapping the hair strands and the ribbon about the roller body so that the hair strands are in between the roller and the ribbon; and temporarily affixing the terminal end of the hair bundle and corresponding segment of the ribbon to the roller body.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
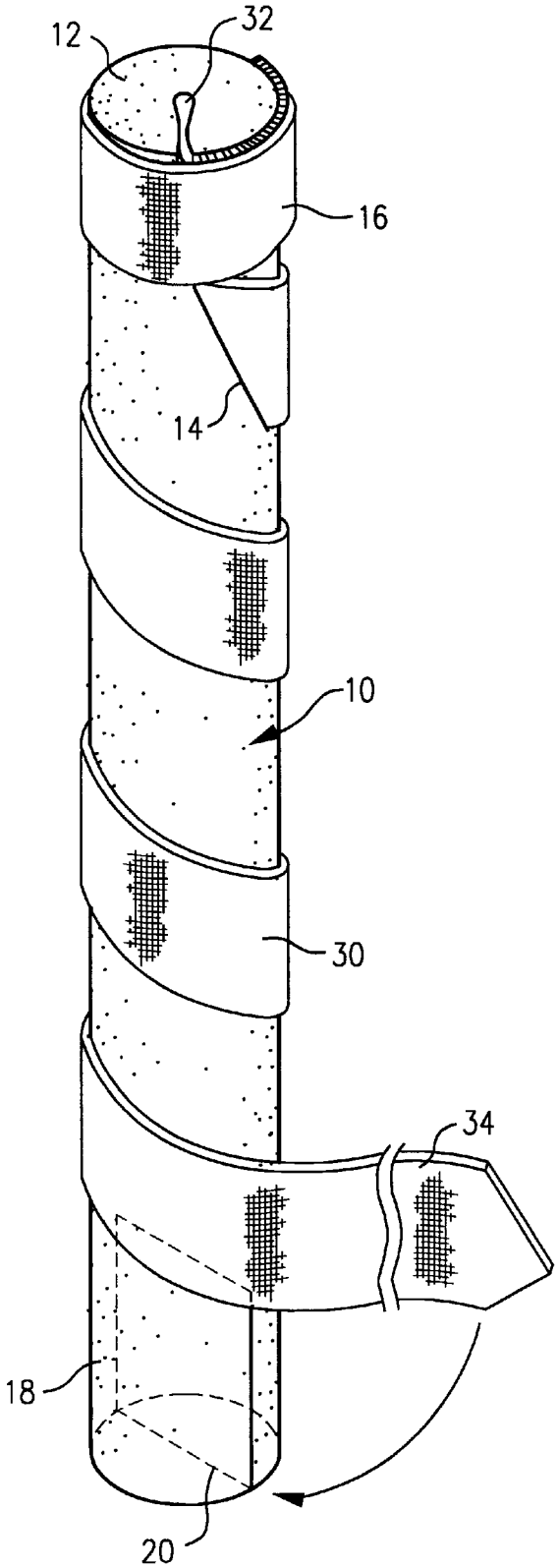
FIG. 1 is a perspective view of a cylindrical solid roller showing the positioning of the ribbon thereon.

Turning now to the several figures wherein like numerals indicate like parts and more specifically to FIG. 1, the invention is shown in perspective view. Roller body 10 is preferably constructed from a cylindrical solid of resilient material such as polyethylene foam or polyurethane foam to allow radial compression of body 10 by ribbon 30, as described below, to import curl to hair therebetween. Formed in first end 12 is helical slit 14 which is shown in more detail in FIG. 2. Helical slit 14 has a depth approximately equal to the radius of body 10 and transverses body 10, in helical fashion, to, for example, approximately 90° from its starting point. The helical orientation of slit 14 allows hair to be inserted therein, as described further below, at a bias that complements the curl angle to be imported to the hair. In contrast, if slit 14 was parallel to the longitudinal axis of roller body 10, the hair inserted in slit 14 would be kinked at the point of initiation of the wrap of the hair around roller body 10 due to the large angle between slit 14 and the desired wrap angle of the hair around body 10, resulting in a less desirable curl. Located in slit 14 is terminal end 32 of ribbon 30. Ribbon 30 is fixedly attached to the internal surface of slit 14 by adhesive, although other means such as fusing, or the like may be employed, as well as creating a physical interlock such as by stitching or threading ribbon 30 through body 10. Removable keeper 16 maintains the cylindrical profile of body 10 and further assists in retaining ribbon 30 to body 10. A radially constricting clip may also be used to permit easy location of a hair strand bundle in slit 14 along with ribbon 30.

Figure 3:
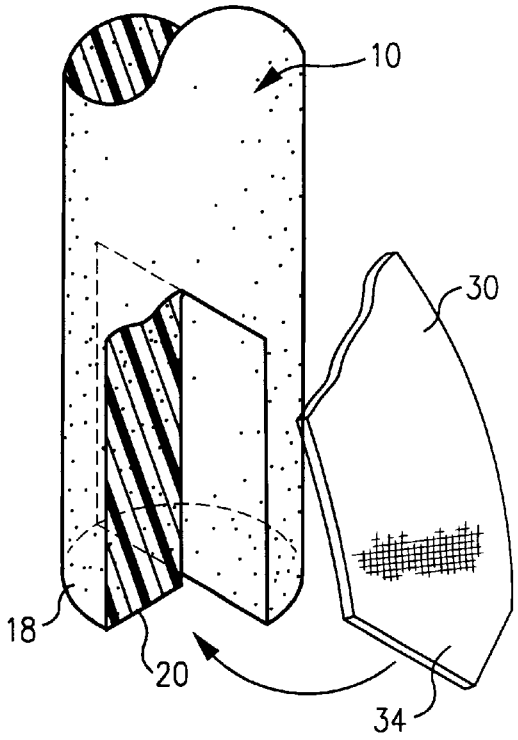
FIG. 3 is a partial perspective view of the second end of the cylindrical solid roller showing the location of the terminal slit for locating a segment of the ribbon.

Ribbon 30 is preferably constructed from a non-elastic, durable, air-permeable material such as a polyethylene cloth, weave, or netting. Any elasticity to ribbon 30 would buckle resilient body 10. As previously detailed, the length of ribbon 30 should be sufficient to permit five revolutions of ribbon 30 about body 10. In the embodiment illustrated in FIG. 1, distal end 34 of ribbon 30 is locatable in second slit 20 at second end 18 of body 10, along with a portion of the wrapped hair. A partial cutaway perspective view of slit 20 is best shown in FIG. 3. Naturally, should only two or three wraps of ribbon 30 be desired, a segment of ribbon 30 intermediate terminal end 32 and distal end 34 can be located in slit 20.

As an alternative to using second slit 20, a band or circlip type device (not shown) can be utilized, for example, when the length of rolled hair does not approach second slit 20. In such circumstances, the band or circlip will retain the position of the hair and ribbon 30 at a user selected position. In this manner, it is not necessary to have bodies of various lengths to accommodate users having different hair lengths, although such possibilities are contemplated by the inventor.

Figure 4:
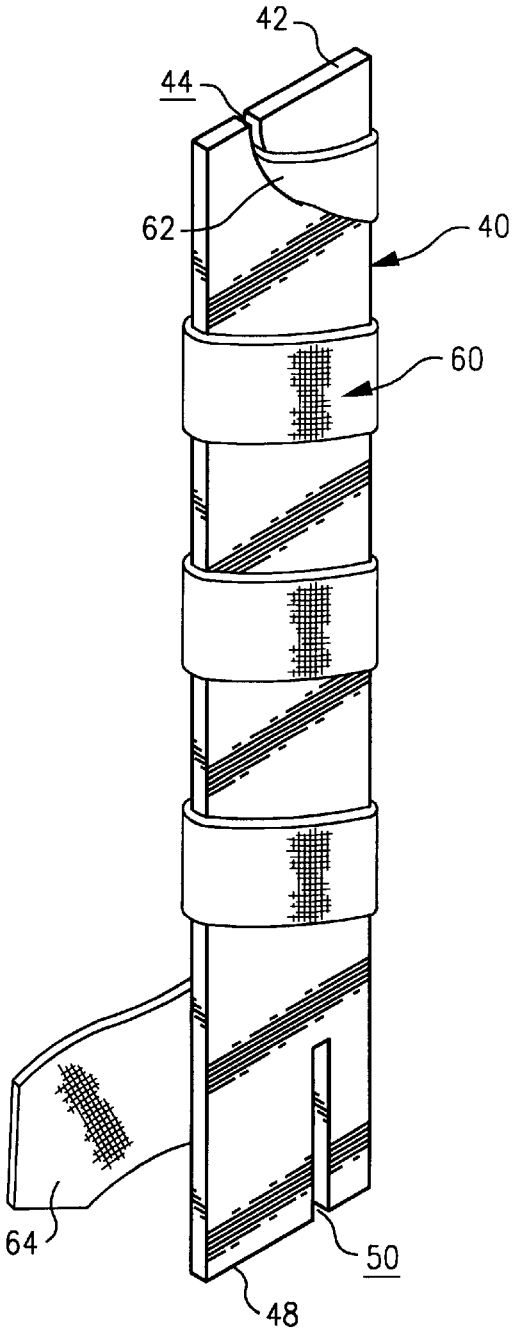
FIG. 4 is a perspective view of a rectangular solid roller showing the positioning of the ribbon thereon.

FIG. 4 illustrates the use of a non-cylindrical roller. Body 40 is a rectangular solid and has the necessary slit 44 at its first end 42 to create the wrapping bias. Located at second end 48 is located slit 50 for receiving the second end 64 of ribbon 60. In all other significant respects, this embodiment of the invention is similar to that shown in FIG. 1.

To use the instant invention, the user unwraps ribbon 30, locates a bundle of hair strands near the scalp into slit 14 (FIG. 1) or slit 44 (FIG. 4) where ribbon 30 is also located, and begins wrapping the hair while overlaying ribbon 30 on the wrapped hair strands. The degree of wrap is user defined. When the wrapping is complete, ribbon 30 or ribbon 60 is frictionally located into slit 20 or slit 50 along with another portion of wrapped hair, and the hair is permitted to dry, thus forming curled hair upon removal of the hair from body 10 or body 40.

Figure 2:
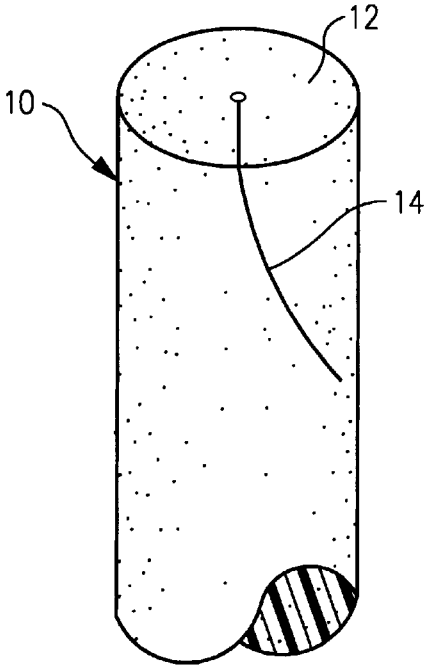
FIG. 2 is a partial perspective view of the helical slit formed in the first end of the cylindrical solid roller wherein the ribbon is locatable therein as shown in FIG. 1.
Figure 5:
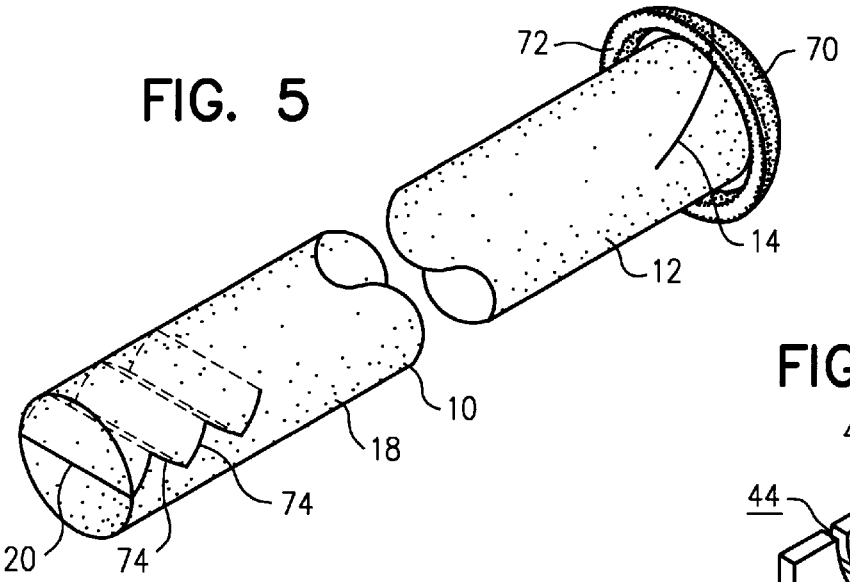
FIG. 5 is a perspective view of a cylindrical roller having an enlarged head on a first end and a serrated slit on a second end.
Figure 6:
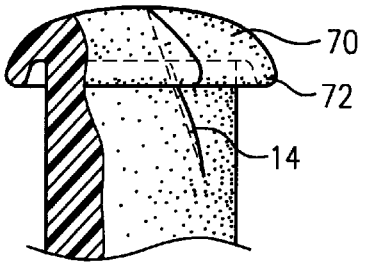
FIG. 6 is a partially exposed view of the enlarged head of the roller of FIG. 5.
Figure 7:
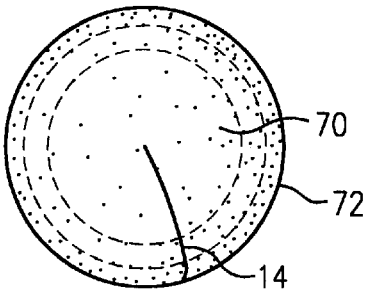
FIG. 7 is a top view of the roller of FIG. 5.

Next referring to FIGS. 5–7, an embodiment is shown that is identical to the embodiment of FIG. 1–3 (which is incorporated herein), except for the elements described below. Note that ribbon 30 is not shown in FIGS. 5–7 for the purpose of more clearly showing underlying body 10; however ribbon 30 is present in the embodiment disclosed in FIGS. 5–7. These two major differences of the embodiment of FIGS. 5–7 compared to that of FIGS. 1–3 is that the embodiment of FIGS. 5–7 has an enlarged head 70 on first end 12 of body 10, and has second slit 20 on second end 18 of body 10 that is serrated. Enlarged head 70 is a substantially circular, convex-shaped member having a peripheral lip 72 that extends outwardly from body 10. Rolled hair is braced against lip 72 to prevent unwanted unwrapping of the rolled hair. Enlarged head 70 provides the user with a gripping area to better manipulate and use the roller of the subject invention. Helical slit 14 passes through head 70, lip 72 and body 10.

Second slit 20 is comprised of a plurality of segments 74, with each segment 74 oriented at an angle relative to adjacent segments 74. Segment 74 thus provide a serrated configuration to slit 20 that better facilitates the securing of ribbon 30 and hair retained in slit 20.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A hair care accessory comprising:

a roller body having a first end, a second end and a circumferential peripheral surface wherein the first end and the peripheral surface of the roller body define a helical first retaining slit that extends from the surface thereof at the first end to impart a helical curl to hair inserted in the slit; and a ribbon having a first end fixedly located in the first retaining slit.

2. The accessory of claim 1 wherein said first end of the roller body has an enlarged head.

3. The accessory of claim 1 wherein the second end of the roller body defines a second retaining slit formed to receive a segment of the ribbon and a portion of hair.

4. The accessory of claim 3 wherein the second retaining slit is serrated.

5. The accessory of claim 1 wherein the ribbon is constructed from a durable and air permeable material.

6. The accessory of claim 1 wherein the roller body is constructed from a solid of resilient material.

7. The accessory of claim 1 wherein the roller body is generally characterized as a rectangular prism.

* * * * *